US008892016B2

(12) United States Patent
Suzuki et al.

(10) Patent No.: US 8,892,016 B2
(45) Date of Patent: Nov. 18, 2014

(54) NIP SURFACE CONFIGURATION FOR A FIXING DEVICE

(71) Applicants: Noboru Suzuki, Komaki (JP); Kei Ishida, Nagoya (JP); Takuji Matsuno, Ichinomiya (JP); Yoshihiro Miyauchi, Ama (JP)

(72) Inventors: Noboru Suzuki, Komaki (JP); Kei Ishida, Nagoya (JP); Takuji Matsuno, Ichinomiya (JP); Yoshihiro Miyauchi, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 16 days.

(21) Appl. No.: 13/623,278

(22) Filed: Sep. 20, 2012

(65) Prior Publication Data

US 2013/0071157 A1 Mar. 21, 2013

(30) Foreign Application Priority Data

Sep. 20, 2011 (JP) ..... 2011-205131

(51) Int. Cl.
*G03G 15/20* (2006.01)

(52) U.S. Cl.
CPC .... *G03G 15/2053* (2013.01); *G03G 2215/2035* (2013.01)
USPC ..... 399/328; 399/329

(58) Field of Classification Search
CPC ..... G03G 15/2025; G03G 15/2075
USPC ..... 399/328, 329
See application file for complete search history.

(56) References Cited

U.S. PATENT DOCUMENTS

| | | | | |
|---|---|---|---|---|
| 6,456,819 | B1 * | 9/2002 | Abe et al. | 399/329 |
| 7,805,102 | B2 * | 9/2010 | Kato | 399/329 |
| 8,195,072 | B2 * | 6/2012 | Okuno | 399/322 |
| 8,224,221 | B2 * | 7/2012 | Matsuki et al. | 399/329 |
| 8,290,416 | B2 * | 10/2012 | Kim | 399/329 |
| 8,306,466 | B2 * | 11/2012 | Creteau et al. | 399/329 |
| 2008/0187372 | A1 * | 8/2008 | Kato | 399/328 |
| 2009/0023088 | A1 * | 1/2009 | Teshima et al. | 430/114 |
| 2009/0110452 | A1 * | 4/2009 | Ogata | 399/331 |
| 2009/0208264 | A1 | 8/2009 | Fujiwara et al. | |
| 2010/0150618 | A1 * | 6/2010 | Kurebayashi et al. | 399/286 |
| 2010/0150619 | A1 * | 6/2010 | Maeda et al. | 399/287 |
| 2011/0150543 | A1 * | 6/2011 | Fujiwara et al. | 399/328 |
| 2012/0163886 | A1 * | 6/2012 | Suzuki | 399/329 |

FOREIGN PATENT DOCUMENTS

JP 2008233886 A 10/2008

* cited by examiner

*Primary Examiner* — G. M. Hyder
(74) *Attorney, Agent, or Firm* — Banner & Witcoff, Ltd.

(57) ABSTRACT

A fixing device which may include a nip plate which has roll marks formed on at least a first surface of the nip plate, a flexible cylindrical member having an inner peripheral surface that is configured to slide on the nip plate and a pressure member that is configured to rotate while the pressure member and the nip plate pinch the flexible cylindrical member, so that the pressure member and the cylindrical member convey a recording sheet. Further, a lubricant may be provided between the nip plate and the flexible cylindrical member. Also, the nip plate may be arranged so that the roll marks extend along a conveying direction of the recording sheet.

21 Claims, 6 Drawing Sheets

NIP SURFACE CONFIGURATION FOR A FIXING DEVICE

CROSS-REFERENCE TO RELATED APPLICATION

This application claims priority to JP2011-205131, filed Sep. 20, 2011, whose contents are expressly incorporated herein by reference.

TECHNICAL FIELD

The present invention relates to a fixing device including a plate-like nip plate.

BACKGROUND

There is known a fixing device including an infrared heater, a nip plate that is heated by the infrared heater, a cylindrical fusing belt, and a pressure roller that pinches the fusing belt between the pressure roller and the nip plate. In this fixing device, the fusing belt rotates by rotation of the pressure roller. A toner image on a sheet is thermally fixed to the sheet when the sheet is conveyed between the pressure roller and the fusing belt. In recent years, the nip plate is formed by rolling with a pair of reduction rolls. In this case, very small protrusions and depressions of the reduction rolls are transferred on surfaces of the nip plate. Hence, a plurality of lines, i.e., roll marks, are formed.

If the nip plate is arranged such that the roll marks are orthogonal to a sheet conveying direction, sliding resistance of the fusing belt with respect to the nip plate increases and the fusing belt may not properly rotate. To improve sliding performance, a lubricant may be applied between the fusing belt and the nip plate. In this case, however, the lubricant is excessively held by the roll marks that are orthogonal to the conveying direction. The sliding resistance of the fusing belt with respect to the nip plate may increase in an area located downstream of the position where the lubricant is held.

SUMMARY

Aspects of the disclosure, relate to a fixing device which may include a nip plate which has roll marks formed on at least a first surface of the nip plate, a flexible cylindrical member having an inner peripheral surface that is configured to slide on the nip plate and a pressure member that is configured to rotate while the pressure member and the nip plate pinch the flexible cylindrical member, so that the pressure member and the cylindrical member convey a recording sheet. Further, a lubricant may be provided between the nip plate and the flexible cylindrical member. Also, the nip plate may be arranged so that the roll marks extend along a conveying direction of the recording sheet.

Additional aspects of the disclosure relate to a fixing device which may include a belt having a surface and a plate that has a surface upon which the surface of the belt is configured to slide in a predetermined direction. Further, the surface of the plate upon which the surface of the belt is configured to slide may have roll marks that extend along the predetermined direction.

Additional aspects of the disclosure relate to a fixing device which may include a belt having a first surface and a second surface, and a nip member that has a first surface upon which the first surface of the belt is configured to slide in a predetermined direction. Further, the first surface of the nip member may have roll marks that extend along the predetermined direction.

Other aspects of the disclosure relate to a fixing device which may include a belt having a surface and a plate that has a first surface upon which the surface of the belt is configured to slide in a predetermined direction and the first surface of the plate has grooves that extend along the predetermined direction.

DETAILED DESCRIPTION

An embodiment of the present invention is described below in detail with reference to the figures. The general configuration of a laser printer 1 (an image forming apparatus) including a fixing device 100 according to an embodiment of the invention is briefly described and then the detailed configuration of the fixing device 100 is described.

The following description applies directions with reference to a user of the laser printer 1. In particular, it is assumed that the right side in FIG. 1 is "front," the left side is "rear," the near side is "left," and the deep side is "right." Also, it is assumed that the up-down direction in FIG. 1 is "up and down."

Figure 1:
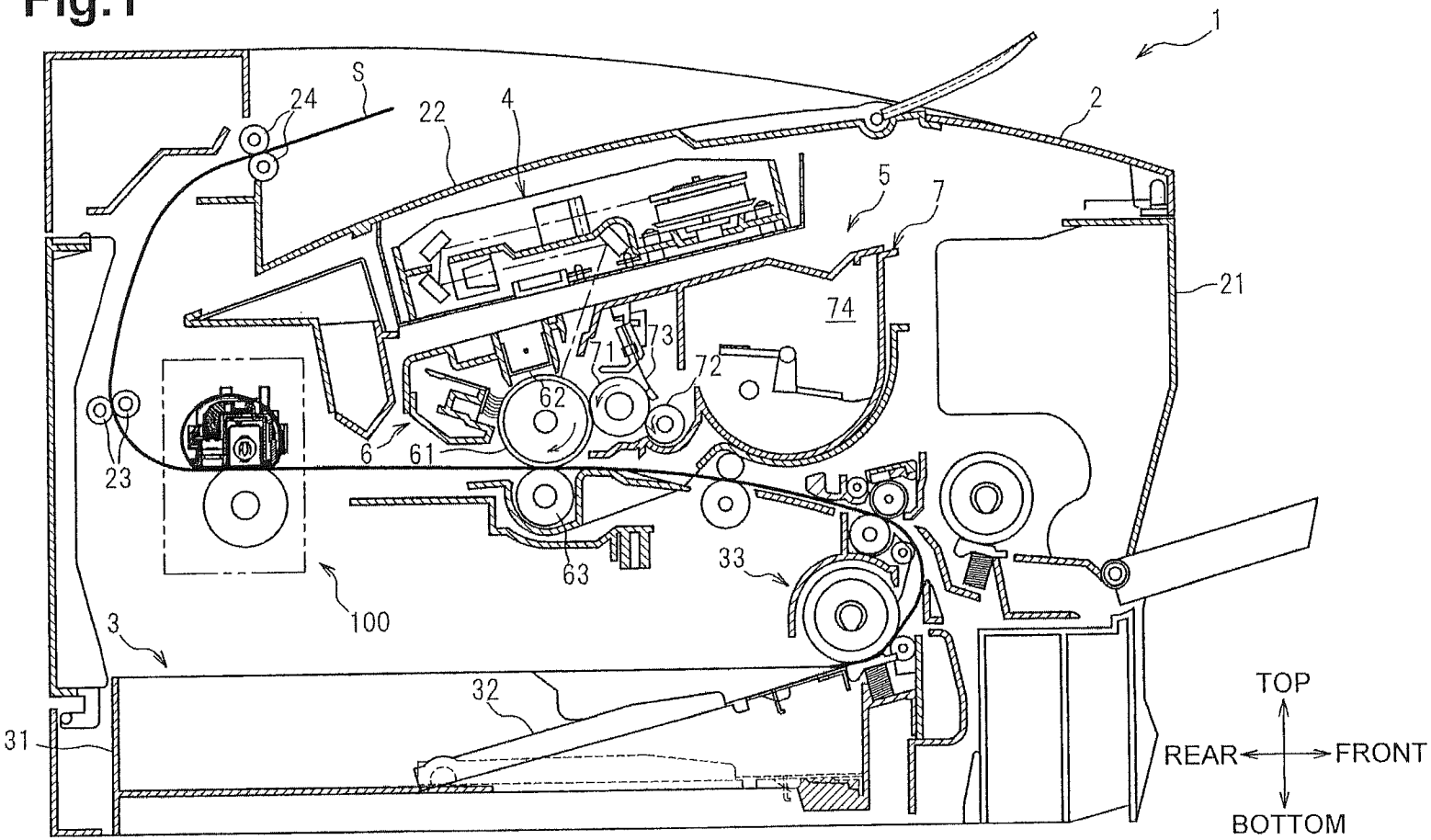
FIG. 1 illustrates a general configuration of a laser printer including a fixing device according to an embodiment of the invention.

As shown in FIG. 1, the laser printer 1 includes a feed portion 3 that feeds a sheet S as an example of a recording sheet, an exposure device 4, a process cartridge 5 that transfers a toner image (a developer image) on the sheet S, and the fixing device 100 that thermally fixes the toner image transferred on the sheet S. The feed portion 3, the exposure device 4, the process cartridge 5, and the fixing device 100 are arranged in a body housing 2.

The feed portion 3 is provided in a lower section of the body housing 2. The feed portion 3 includes a feed tray 31, a sheet push plate 32, and a feed mechanism 33. The sheet S housed in the feed tray 31 is lifted upward by the sheet push plate 32, and is fed by the feed mechanism 33 toward the process cartridge 5 (an area between a photosensitive drum 61 and a transfer roller 63).

The exposure device 4 is arranged in an upper section of the body housing 2. The exposure device 4 includes a laser light-emitting portion (not shown), a polygonal mirror (shown without a reference sign), a lens (shown without a reference sign), and a reflection mirror (shown without a reference sign). The exposure device 4 exposes the surface of the photosensitive drum 61 to light by scanning the surface of the photosensitive drum 61 at a high speed with laser light (see a dotted-chain line) emitted from the laser light-emitting portion based on image data.

The process cartridge 5 is arranged below the exposure device 4. The process cartridge 5 is removably mounted on the body housing 2 through an opening that appears when a front cover 21 provided at the body housing 2 is open. The process cartridge 5 includes a drum unit 6 and a developing unit 7.

The drum unit 6 includes the photosensitive drum 61, a charging unit 62, and the transfer roller 63. The developing unit 7 is removably mounted on the drum unit 6. The developing unit 7 includes a developing roller 71, a feed roller 72, a layer-thickness regulation blade 73, and a toner container 74 that houses a toner (a developer).

In the process cartridge 5, the charging unit 62 charges the surface of the photosensitive drum 61 uniformly with electricity and then the exposure device 4 exposes the surface of the photosensitive drum 61 to the laser light by high-speed scanning. Hence, an electrostatic latent image based on image data is formed on the photosensitive drum 61. The toner in the toner container 74 is fed to the developing roller 71 through the feed roller 72, enters an area between the developing roller 71 and the layer-thickness regulation blade 73, and is held on the developing roller 71 as a thin layer with a constant thickness.

The toner held on the developing roller 71 is fed from the developing roller 71 to the electrostatic latent image formed on the photosensitive drum 61. Hence, the electrostatic latent image becomes a visible image, and a toner image is formed on the photosensitive drum 61. Then, when a sheet S is conveyed between the photosensitive drum 61 and the transfer roller 63, the toner image on the photosensitive drum 61 is transferred on the sheet S.

The fixing device 100 is provided at the rear of the process cartridge 5. The toner image transferred on the sheet S is thermally fixed to the sheet S when the sheet S passes through the fixing device 100. Then, the sheet S is output on an output tray 22 by convey rollers 23 and 24.

Figure 2:
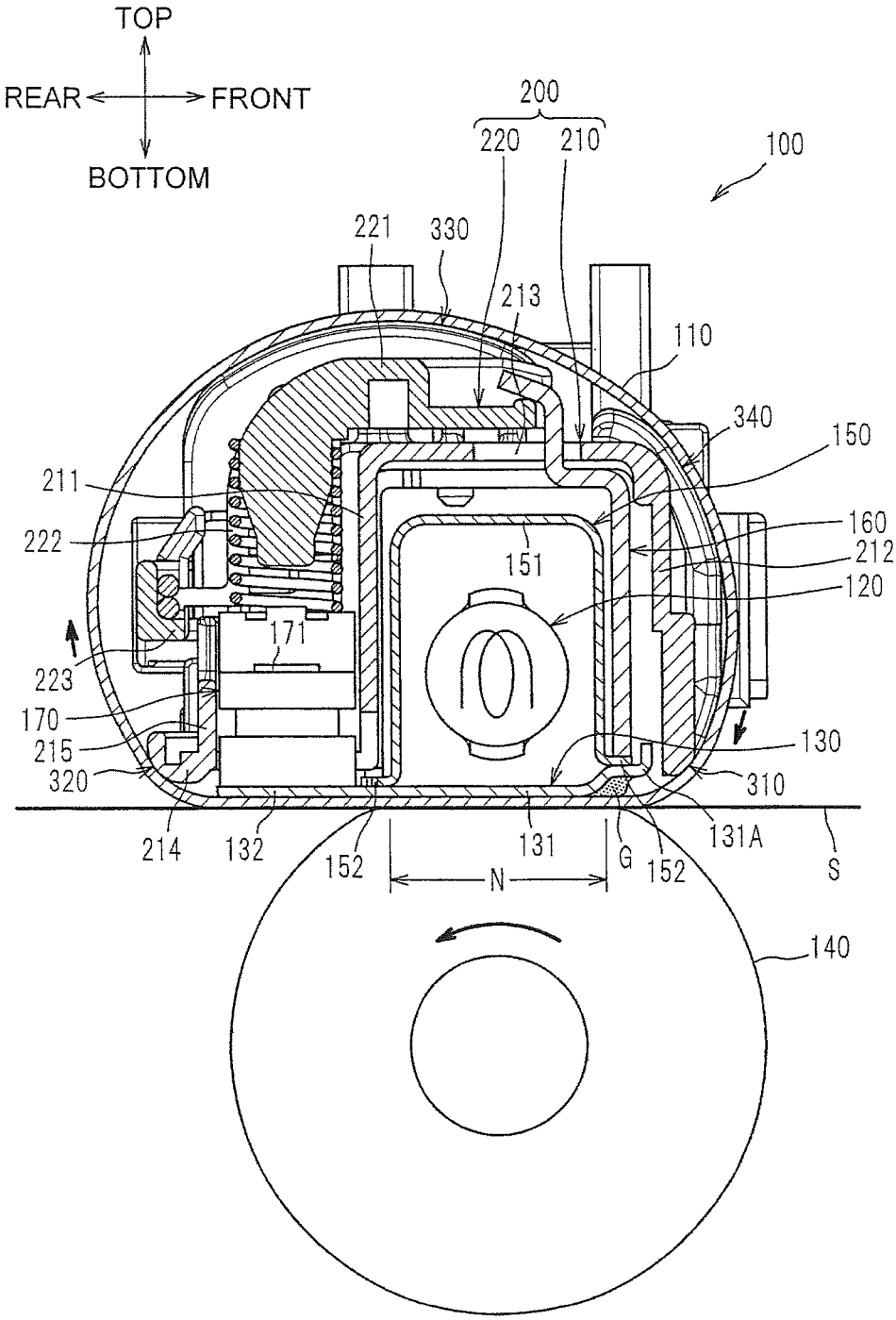
FIG. 2 is a cross-sectional view of the fixing device.

Referring to FIG. 2, the fixing device 100 may include a fusing belt 110 as an example of a cylindrical member, a halogen lamp 120, a nip plate 130, a pressure roller 140 as an example of a pressure member, a reflection member 150, and a stay 160.

Figure 3:
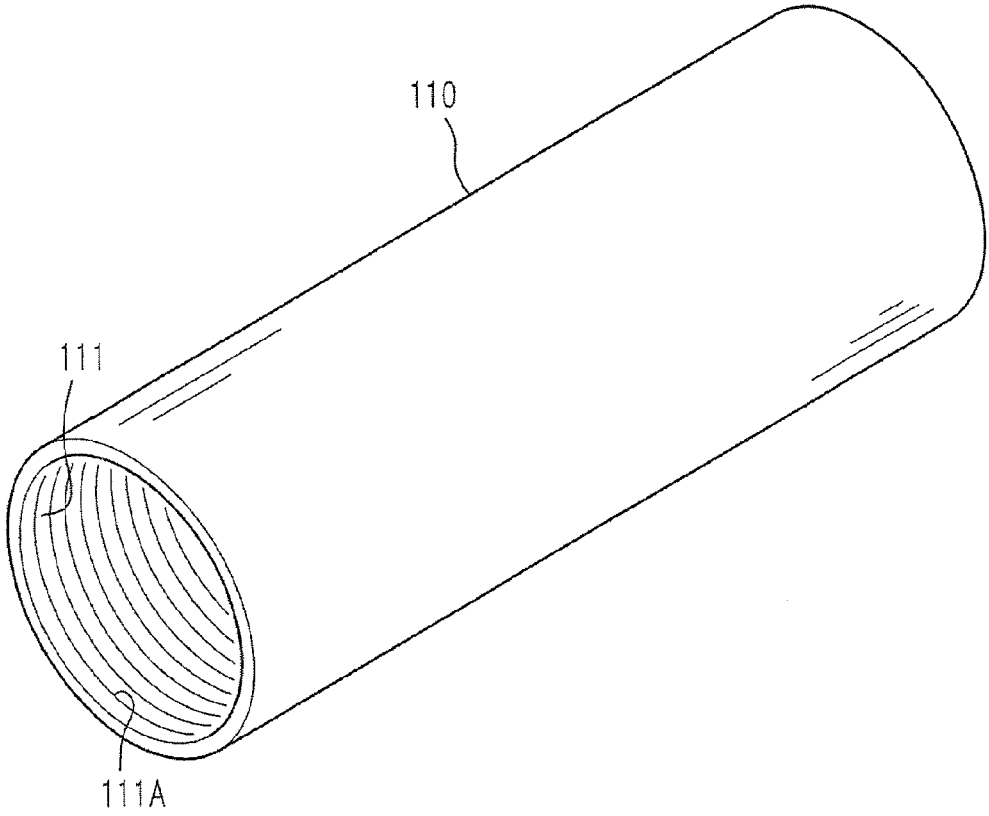
FIG. 3 is a perspective view showing polishing marks formed at an inner peripheral surface of a fusing belt.

The fusing belt 110 is an endless (cylindrical) belt that may be made of stainless steel and that is heat resistant and flexible. Referring to FIG. 3, the fusing belt 110 has an inner peripheral surface 111 with polishing marks 111A. The polishing marks 111A are formed when the fusing belt 110 is polished by spinning or the like in a rotation direction of the fusing belt 110, in the form of streaks along the rotation direction. Hence, the polishing marks 111A at the inner peripheral surface 111 do not cause a resistance to be generated when the fusing belt 110 rotates. Therefore, sliding performance of the inner peripheral surface 111 of the fusing belt 110 with respect to the other members can be improved.

The rotation of the fusing belt 110 is guided by a guide portion (a nip upstream guide 310, a nip downstream guide 320, an upper guide 330, and a front guide 340) that is formed at a frame member 200. The frame member 200 may include a first frame 210 and a second frame 220.

The first frame 210 may have a substantially U-like shape in cross-section view and extends in the left-right direction. The first frame 210 covers the stay 160 at a side opposite to the halogen lamp 120 with respect to the stay 160. The first frame 210 may include a rear wall 211, a front wall 212, an upper wall 213 extending so as to connect the upper ends of the rear wall 211 and front wall 212 with each other, and an extension wall 214 extending rearward from the lower end of the rear wall 211.

The front guide 340 that guides a front section of the fusing belt 110 is formed near the right end of the front wall 212. The nip upstream guide 310 that guides a lower front section of the fusing belt 110 is formed at the lower end of the front wall 212. Also, the nip downstream guide 320 that guides a lower rear section of the fusing belt 110 is formed at the rear end of the extension wall 214.

The second frame 220 may have a substantially L-like shape in cross-sectional view and extends in the left-right direction. The second frame 220 covers part of the rear wall 211 and part of the upper wall 213 of the first frame 210. The second frame 220 may include an upper wall 221, a rear wall 222 extending downward from the rear end of the upper wall 221, and an extension wall 223 extending rearward from the lower end of the rear wall 222. The upper guide 330 that guides an upper section of the fusing belt 110 is formed at the upper wall 221.

The halogen lamp 120 is a member that applies heat to the toner on the sheet S by generating radiant heat and applying the heat to the nip plate 130 and the fusing belt 110 (a nip portion N). The halogen lamp 120 is arranged inside the fusing belt 110 at predetermined distances from inner surfaces of the fusing belt 119 and the nip plate 130.

Figure 4:
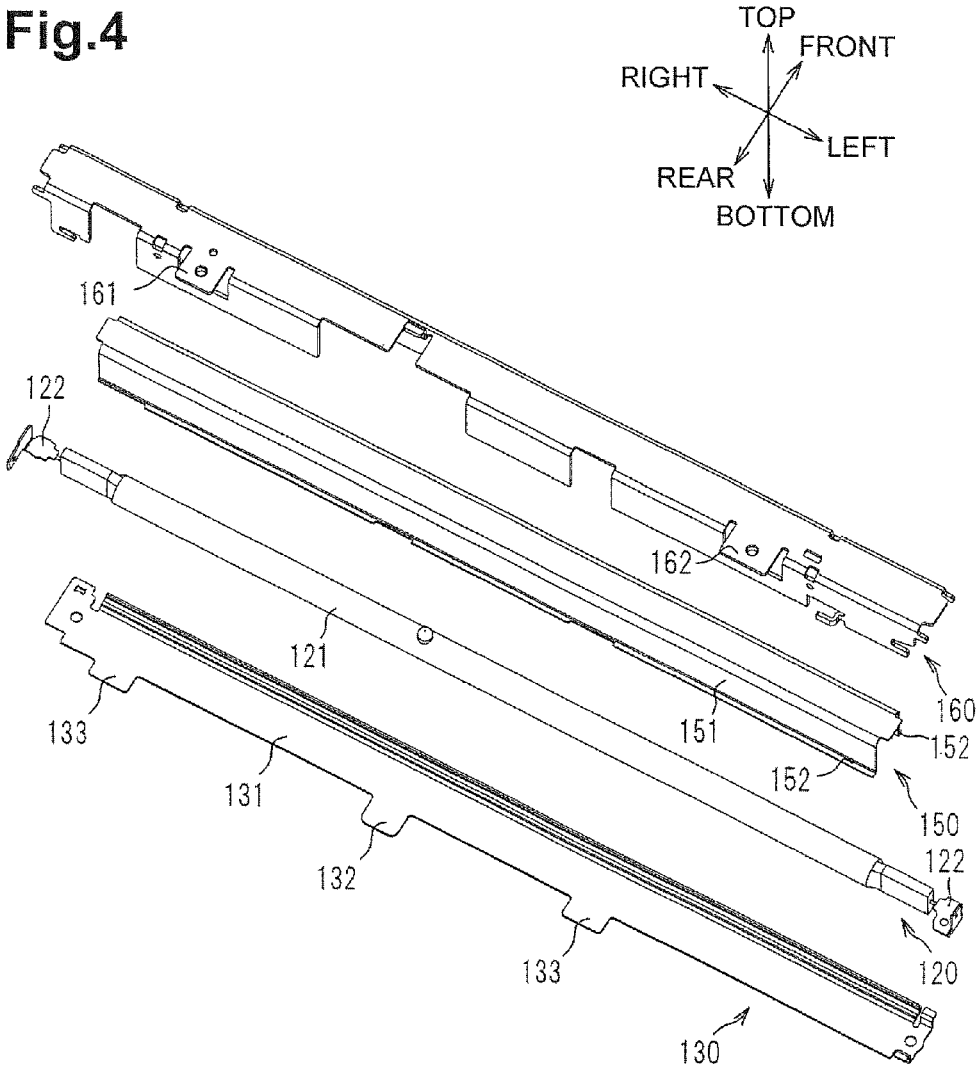
FIG. 4 is a perspective view showing a nip plate, a halogen lamp, a reflection member, and a stay.

Referring to FIG. 4, the halogen lamp 120 includes a filament (not shown) in a long cylindrical glass tube 121. Both ends in the longitudinal direction of the glass tube 121 are closed and inert-gas containing a halogen element is sealed in the glass tube 121. A pair of electrodes 122 are provided at both ends in the longitudinal direction of the halogen lamp 120. The pair of electrodes 122 are electrically connected with ends of the filament in the glass tube 121.

Referring back to FIG. 2, the nip plate 130 is a plate-like member that receives the radiant heat from the halogen lamp 120. The inner peripheral surface 111 of the fusing belt 110 slides on the lower surface of the nip plate 130. In this embodiment, the nip plate 130 is made of metal, and is formed by bending a metal plate, for example, an aluminum plate having a higher thermal conductivity than the thermal conductivity of the stay 160 made of steel (described later). If the nip plate 130 is made of aluminum, the thermal conductivity of the nip plate 130 can be increased.

Figure 5:
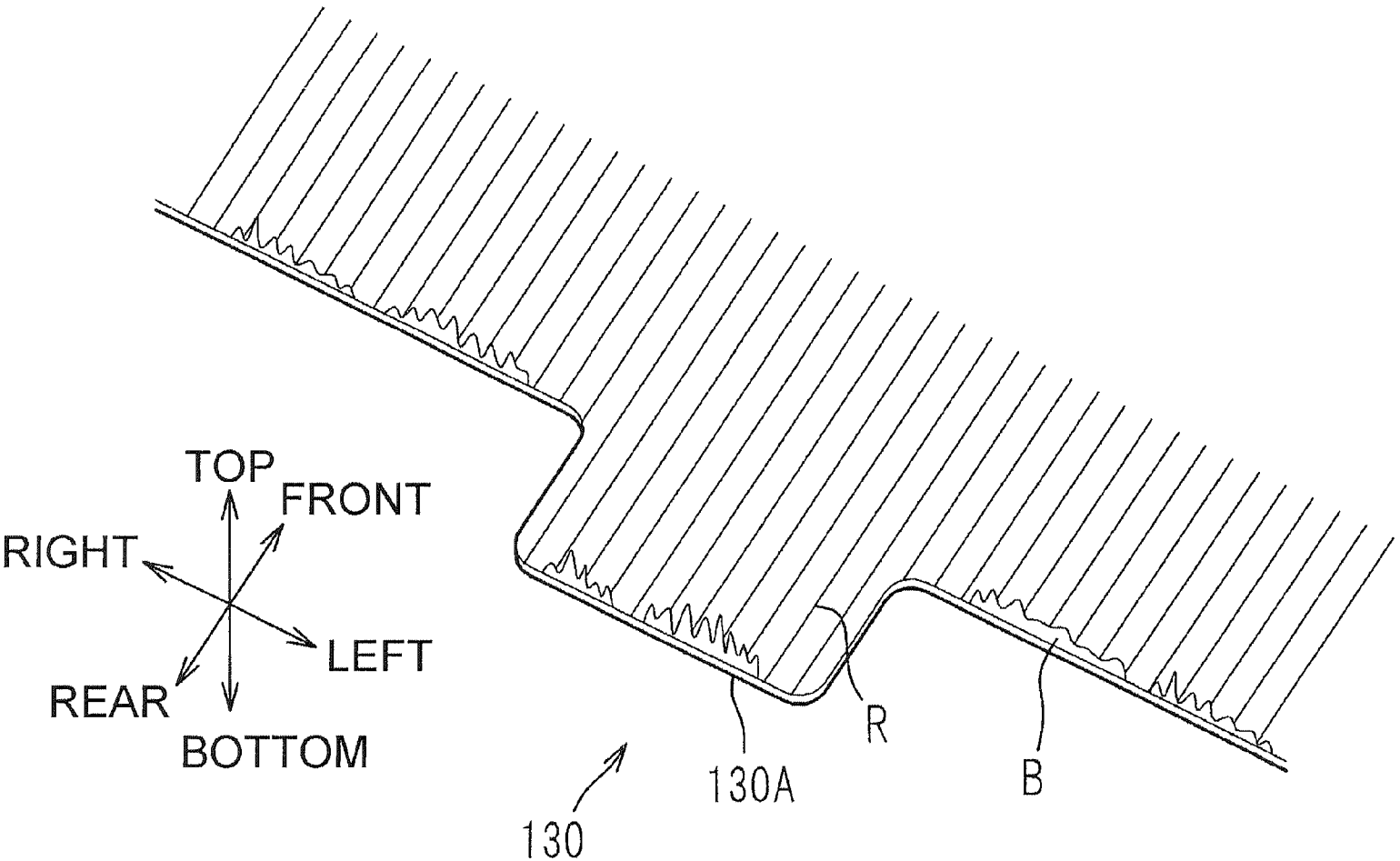
FIG. 5 is an explanatory view showing in an exaggerated manner roll marks and burrs formed at the nip plate.

The nip plate 130 is formed into an illustrated shape by pressing a plate member formed by rolling. As shown in FIG. 5, the nip plate has roll marks R that are formed at surfaces of the nip plate 130 by reduction rolls during rolling. The nip plate 130 is arranged such that roll marks R extend along the front-rear direction (a conveying direction of the sheet S). Although FIG. 5 illustrates only the upper surface of the nip plate 130, the roll marks R are also similarly formed at the lower surface (a sliding surface) of the nip plate 130.

Since the roll marks R extend along the conveying direction of the sheet S, the sliding performance of the fusing belt 110 with respect to the nip plate 130 can be improved. In particular, if both the fusing belt 110 and the nip plate 130 are made of metal like this embodiment, the sliding resistance of the fusing belt 110 with respect to the nip plate 130 may be large. However, since the roll marks R extend along the conveying direction, the sliding performance of the fusing belt 110 can be improved.

Also, since the roll marks R extend along the conveying direction of the sheet S, a lubricant G (see FIG. 2) provided between the nip plate 130 and the fusing belt 110 can be prevented from being excessively held by the nip plate 130.

A rear edge portion 130A (an edge portion that may contact with the fusing belt 110) of the nip plate 130 is formed such that burrs B formed during pressing face the upper side (the inside of the fusing belt 110). This can prevent the fusing belt 110 from being hooked to the burrs B. Therefore, the sliding performance of the fusing belt 110 can be further improved.

Figure 6:
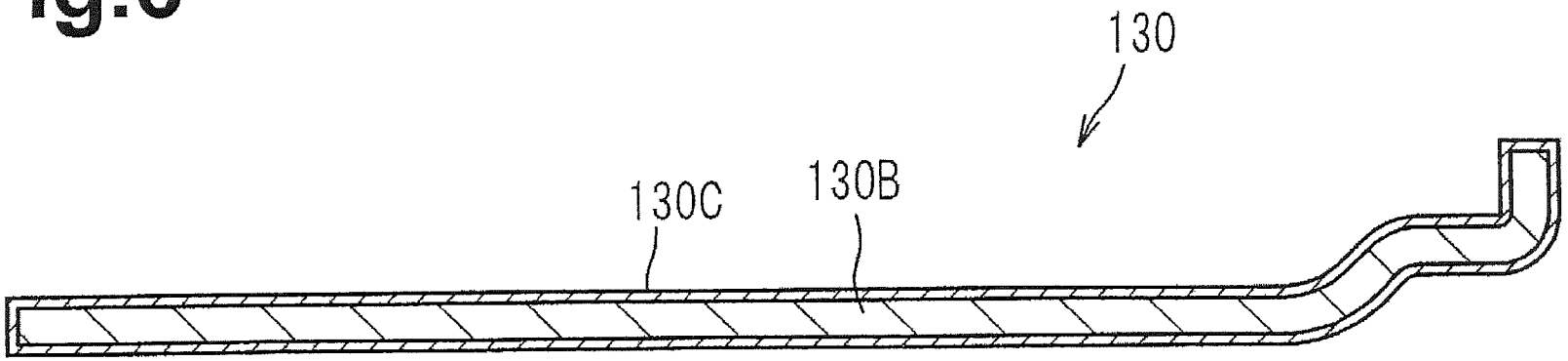
FIG. 6 is a cross-sectional view showing in an exaggerated manner a protection layer formed on a surface of the nip plate.

Referring to FIG. 6, the nip plate 130 includes a body portion 130B made of metal, and a protection layer 130C that covers the entire surface of the body portion 130B. The protection layer 130C is harder than the inner peripheral surface 111 of the fusing belt 110.

To be more specific, the protection layer 130C has a higher hardness than the hardness of the inner peripheral surface 111 of the fusing belt 110 made of stainless steel (for example, the inner peripheral surface 111 has a Hv hardness of about 400 if the fusing belt 110 is made of SUS304). Hence, the protection layer 130C can keep the shape of the roll marks R. The above-mentioned effect of the roll marks R can be maintained for a long period of time.

In this embodiment, the protection layer 130C is a layer formed by the process of forming a layer with a material that is harder than the inner peripheral surface 111 of the fusing belt 110 and that is different from the material of the body portion 130B. To be more specific, the protection layer 130C is a layer plated with a nickel-phosphorus alloy, and the layer is formed on the surface of the body portion 130B by known electroless nickel-phosphorus plating. Further, in this embodiment, the protection layer 130C is formed on the surface of the body portion 1308 by the electroless nickel-phosphorus plating and then by baking (for example, at 200° C. for 1 hour). Accordingly, the protection layer 130C has a hardness (Hv hardness) in a range from about 500 to about 700.

Since the post baking is provided after the plating, the shape of the roll marks R can be further kept as compared with that only the plating is performed.

The protection layer 130C preferably has a thickness in a range from about 5 to about 15 μm. The protection layer 130C can have a sufficient durability as long as the thickness of the protection layer 130C is 5 μm or larger, and the protection layer 130C can be a stable layer (a uniform layer) while productivity is maintained as long as the thickness of the protection layer 130C is 15 μm. For example, if the thickness of the body portion 130B (an aluminum alloy plate) is 0.6 mm, the thickness of the protection layer 130C may be 10 μm. It is to be noted that FIG. 6 illustrates the thickness in an exaggerated manner to clearly show the protection layer 130C.

Referring to FIG. 4, the nip plate 130 includes a base portion 131, a first protrusion 132, and a second protrusion 133.

The base portion 131 slides on the inner peripheral surface 111 of the fusing belt 110. The base portion 131 transfers the heat from the halogen lamp 120 to the toner on the sheet S through the fusing belt 110. An upstream end portion 131A in the conveying direction of the base portion 131 has a shape that curves or bends away from the fusing belt 110, then extends substantially in parallel to the conveying direction toward the upstream side in the conveying direction, and then extends toward the upper side. Since the end portion 131A has a part that bends in the form of a curve to warp upward, the fusing belt 110 can be prevented from wearing which may occur when the fusing belt 110 rubs against the edge of the nip plate 130.

The first protrusion 132 and the second protrusion 133 are flat plates, and protrude rearward from the rear end of the base portion 131. A single first protrusion 132 is formed at a position near the center in the left-right direction of the rear end of the base portion 131. A thermostat 170 (see FIG. 2) is arranged on the upper surface of the first protrusion 132 to face the first protrusion 132. Also, two second protrusions 133 are respectively formed at positions near the center and right end in the left-right direction of the rear end of the base portion 131. Two thermistors (not shown) are respectively arranged on the upper surfaces of the second protrusions 133 to face the second protrusions 133.

Referring to FIG. 2, the pressure roller 140 and the nip plate 130 form the nip portion N between the fusing belt 110 and the pressure roller by pinching the fusing belt 110 therebetween.

The pressure roller 140 is arranged below the nip plate 130. In this embodiment, one of the nip plate 130 and the pressure roller 140 is urged to the other to form the nip portion N. Hence, the pressure roller 140 rotates while the pressure roller 140 and the nip plate 130 pinch the fusing belt 110, so that the pressure roller 140 and the fusing belt 110 convey the sheet S.

The pressure roller 140 is rotationally driven when a drive force is transmitted thereto from a motor (not shown) provided in the body housing 2. The fusing belt 110 is rotated by the rotation of the pressure roller 140 because of a friction force of the pressure roller 140 against the fusing belt 110 (or the sheet S). The sheet S with the toner image transferred thereon is conveyed through an area between the pressure roller 140 and the heated fusing belt 110 (the nip portion N). Accordingly, the toner image (the toner) is thermally fixed.

The reflection member 150 reflects the radiant heat from the halogen lamp 120 toward the nip plate 130. The reflection member 150 is arranged at a predetermined distance from the halogen lamp 120 so as to surround (cover) the halogen lamp 120 inside the fusing belt 110.

The reflection member 150 is formed by bending a material with a high reflectivity for infrared radiation and far-infrared radiation, for example, an aluminum plate, into a substantially U-like shape in cross-sectional view. To be more specific, the reflection member 150 includes a reflection portion 151 having a curve shape, and flange portions 152 extending outward in the front-rear direction from both end portions in the front-rear direction of the reflection portion 151.

The stay 160 supports front and rear end portions of the nip plate 130 (the base portion 131) through the reflection member 150 (the flange portions 152), and, hence, receives a load from the pressure roller 140. The stay 160 is arranged inside the fusing belt 110 so as to cover the reflection member 150. It is noted that, if the nip plate 130 urges the pressure roller 140, the load is a reactive force of the urging force applied by the nip plate 130 to the pressure roller 140.

The stay 160 is formed by bending a material with a relatively high rigidity, for example, a steel sheet into a substantially U-like shape in cross-sectional view along the outer surface shape of the reflection member 150 (the reflection portion 151). Referring to FIG. 4, the stay 160 includes a right fixing portion 161 provided at the right and a left fixing portion 162 provided at the left. The right fixing portion 161 and the left fixing portion 162 extend rearward from an upper wall of the stay 160, and respectively have screw holes (illustrated without a reference sign) that respectively penetrate through the right fixing portion 161 and the left fixing portion 162.

The embodiment of the present invention has been described above; however, the present invention is not limited to the above-described embodiment. The specific configuration may be appropriately modified within the scope of the present invention.

In the above-described embodiment, the protection layer 130C is a layer formed such that the surface of the body portion 1308 is processed by plating and then baking. The present invention is not limited thereto. For example, the protection layer may be a layer formed such that the surface of the body portion is processed only by plating. For example, when electroless nickel plating or the like is performed, the hardness increases if baking (heat processing) is performed. Thus, a protection layer with a higher hardness can be formed.

Alternatively, the protection layer does not have to be formed by plating (e.g., processing of forming a layer of a material different from the material of the body portion, on the surface of the body portion). For example, the protection layer may be an alteration layer formed such that the surface of the body portion is altered to have a harder hardness than the hardness of the inner peripheral surface of the fusing belt (the cylindrical member). For example, processing of altering the surface of the body portion to have the higher hardness than the hardness of the inner peripheral surface of the cylindrical member (processing of increasing the hardness) may be oxidation or nitriding. For example, if the body portion is made of an aluminum alloy, the protection layer may be formed by altering the surface of the body portion to have a higher hardness than the hardness of the inner peripheral surface of the cylindrical member by alumite treatment (hard alumite treatment) the surface of the body portion. In other words, a coating layer produced by alumite treatment the surface of the body portion made of an aluminum alloy serves as the protection layer.

In the above-described embodiment, the protection layer 130C covers the entire surface of the body portion 130B. However, the present invention is not limited thereto. According to the present invention, the protection layer may be formed at least at a surface that slides on the inner peripheral surface of the cylindrical member.

In the above-described embodiment, the fusing belt 110 (the cylindrical member) is made of stainless steel. However, the present invention is not limited thereto. The fusing belt 110 may be formed of another metal, resin such as polyimide resin, or an elastic material such as rubber. If the fusing belt 110 is made of resin, the sliding resistance of the fusing belt 110 with respect to the nip plate 130 made of metal can be decreased. The sliding performance of the fusing belt 110 can be further improved.

Also, the cylindrical member may have a multilayer structure. To be more specific, for example, a resin layer for decreasing the sliding resistance may be provided on the surface of the metal belt, or an elastic layer such as a rubber layer may be provided on the surface of the metal belt.

In the above-described embodiment, the upstream end portion 131A in the conveying direction of the nip plate 130 warps to the inside of the fusing belt 110. However, the present invention is not limited thereto. A downstream end portion in the conveying direction may warp.

In the above-described embodiment, the pressure roller 140 exemplarily serves as the pressure member. However, the present invention is not limited thereto. For example, a belt-like pressure member may be used.

In the above-described embodiment, the sheet S, such as normal paper or a post card, exemplarily serves as the recording sheet. However, the present invention is not limited thereto. For example, an OHP sheet (a transparency film used for an overhead projector) may be used.

In the above-described embodiment, the laser printer 1 that forms a monochrome image exemplarily serves as the image forming apparatus including the fixing device according to the present invention. However, it is not limited thereto. For example, a printer that forms a color image may be used. Also, the image forming apparatus is not limited to the printer, and may be, for example, a copier or a multi-function apparatus including a document reading device such as a flatbed scanner.

The invention claimed is:

1. A fixing device comprising:

a nip plate having roll marks formed on at least a first surface of the nip plate, the nip plate including:

a body portion which includes metal; and a protection layer;

a flexible cylindrical member having an inner peripheral surface configured to slide on the nip plate; and a pressure member configured to rotate while the pressure member and the nip plate pinch the flexible cylindrical member, so that the pressure member and the cylindrical member convey a recording sheet, wherein the protection layer is positioned at a location of the body portion on which the inner peripheral surface of the flexible cylindrical member slides, wherein the protection layer is harder than the inner peripheral surface of the flexible cylindrical member, wherein a lubricant is provided between the nip plate and the flexible cylindrical member, and wherein the nip plate is arranged so that the roll marks extend along a conveying direction of the recording sheet.

2. The fixing device according to claim 1, wherein the nip plate has an edge portion that is in contact with the flexible cylindrical member, and the edge portion is positioned such that any burrs included on the edge portion face away from the portion of the flexible cylindrical member in contact with the edge portion.

3. The fixing device according to claim 1, wherein an end portion in the conveying direction of the nip plate bends away from the cylindrical member.

4. The fixing device according to claim 1, wherein the cylindrical member includes metal.

5. The fixing device according to claim 4, wherein polishing marks are formed at the inner peripheral surface of the cylindrical member and extend in a rotation direction of the cylindrical member.

6. The fixing device according to claim 1, wherein the cylindrical member includes resin.

7. The fixing device according to claim 1, wherein the nip plate includes aluminum.

8. The fixing device according to claim 1, wherein the protection layer includes a plated surface along which the flexible cylindrical member is configured to slide.

9. The fixing device according to claim 8, wherein the protection layer includes a plated and baked surface along which the flexible cylindrical member is configured to slide.

10. The fixing device according to claim 1, wherein the protection layer includes an altered layer such that the sliding surface is harder than the inner peripheral surface of the cylindrical member.

11. A fixing device comprising:

a belt having a surface; and a plate that has a surface upon which the surface of the belt is configured to slide in a predetermined direction, and the surface of the plate upon which the surface of the belt is configured to slide has roll marks that extend along the predetermined direction, the plate further including:

a body portion which includes metal and the surface of the plate on which the surface of the belt slides; and a protection layer, wherein the protection layer is positioned at a location of the plate on which the surface of the belt slides, and wherein the protection layer is harder than the surface of the belt.

12. The fixing device according to claim 11, wherein the belt includes metal.

13. The fixing device according to claim 12, wherein the surface of the belt has polishing marks.

14. The fixing device according to claim 11, wherein the belt includes resin.

15. The fixing device according to claim 11, wherein the plate includes aluminum.

16. The fixing device according to claim 11, wherein the protection layer includes a plated surface along which the belt is configured to slide.

17. The fixing device according to claim 16, wherein the protection layer includes a plated and baked surface along which the belt is configured to slide.

18. The fixing device according to claim 11, wherein the protection layer includes an altered layer such that the surface of the plate upon which the surface of the belt is configured to slide is harder than the surface of the belt.

19. The fixing device according to claim 11, the protection layer has a thickness in a range from about 5 to about 15 μm.

20. A fixing device comprising:

a belt having a first surface and a second surface; and a nip member that has a surface upon which the first surface of the belt is configured to slide in a predetermined direction, the nip member including:

a body portion which includes metal; and a protection layer, wherein the protection layer is positioned at a location of the body portion on which the first surface of the belt slides, wherein the protection layer is harder than the first surface of the belt, and wherein the surface of the nip member has roll marks that extend along the predetermined direction.

21. A fixing device comprising:

a belt having a surface; and a plate that has a surface upon which the surface of the belt is configured to slide in a predetermined direction, and the surface of the plate has grooves that extend along the predetermined direction, wherein the plate includes:

a body portion which includes metal and the surface of the plate on which the surface of the belt is configured to slide; and a protection layer, wherein the protection layer is positioned at a location of the plate on which the surface of the belt slides, and wherein the protection layer is harder than the surface of the belt.

* * * * *